US005388695A

United States Patent [19]

Gilbert

[11] Patent Number: 5,388,695

[45] Date of Patent: Feb. 14, 1995

[54] FLAT TRAPEZOIDAL CONTAINER OF BRIGHTLY PRINTED THERMALLY SEALABLE FILM

[75] Inventor: Scott R. Gilbert, Hinckley, Ohio

[73] Assignee: Professional Package Company, Strongsville, Ohio

[21] Appl. No.: 248,391

[22] Filed: May 23, 1994

[51] Int. Cl.[6] ..... B65D 75/12; B65D 65/18; B65D 65/46

[52] U.S. Cl. ..... 206/423; 206/457; 206/459.5; 229/87.06; 229/87.08; 47/72

[58] Field of Search ..... 206/423, 528, 457, 459.5, 206/540; 229/87.06, 87.08; 47/72; D9/306

[56] References Cited

U.S. PATENT DOCUMENTS

| | | | |
|---|---|---|---|
| D. 259,333 | 5/1981 | Chasbonneau | D9/306 |
| 4,297,811 | 11/1981 | Weder | 47/72 |
| 4,333,267 | 6/1982 | Witte | 47/72 X |
| 4,413,725 | 11/1983 | Bruno et al. | 206/423 X |
| 5,228,234 | 7/1993 | de Klerk et al. | 206/423 X |
| 5,315,785 | 5/1994 | Arot et al. | 47/72 |

*Primary Examiner*—Jacob K. Ackun, Jr.
*Attorney, Agent, or Firm*—Alfred D. Lobo

[57] ABSTRACT

A flat trapezoidal container provides a generally frusto-conical bag with a single cavity when at least partially filled with a pulverulent material such as soil which may have a live plant growing therein, or comestible goods such as popcorn and other snacks which rely heavily upon spur-of-the-moment purchases by a customer who must first be visually attracted to the goods, thereafter be visually convinced of their freshness, and have the opportunity to smell and/or touch the goods prior to purchasing them. The container may also be specifically dimensioned to snugly sheath a flower pot so as to leave therebeneath, a surplus of film in an empty transition zone which is concealable under the flower pot. The container is made from two flat panels of heat-sealable film, each shaped as a trapezium; or from a single web folded double. The lower portion of the container is ornamentally imprinted along a border extending beneath a generally lateral line above the longitudinal axis of the web, to identify the contents and simulate them in their optimum condition to enhance their marketability; and, with a marker in the upper portion, quantifies the volume of the goods contained, or provides instructions for their use. When the cavity is distended by being partially filled, the entire container, except for a transition zone, presents a smoothly arcuate surface of the frustum of a cone.

19 Claims, 8 Drawing Sheets

FLAT TRAPEZOIDAL CONTAINER OF BRIGHTLY PRINTED THERMALLY SEALABLE FILM

BACKGROUND OF THE INVENTION

This invention relates to a non-closable container having an open mouth defined by the upper edges of a pair of trapezoidal panels heat-sealed along three edges of a pair of overlying webs, or along the side edges of a single web folded double. The container exhibits a desired visual effect by a means which (a) includes coloration and decorative ornamentation, (b) forms a trapezoidal configuration with essentially no thickness when collapsed, and a generally frustoconical shape when partially filled, and (c) suggests either the goods contained or the appearance of a live plant when one is placed in a container of appropriate size. The container most preferably includes a static information exhibiting means in the upper portion of its exterior surface, specifically modified by ornamented indicia which provides the static information. In a particular embodiment, the container contains an edible product and visual information desired to be communicated to the user concerning the product or the utilization of the product, and the characters providing the information are in contrasting colors.

Commercially acceptable containers in the marketplace for the packaging of small solid goods are required, not only to package the particular goods effectively, but to help sell those goods to the consumer. Preferably, the container helps to entice the consumer to purchase the goods on the spur of the moment. Such goods are easily portable from the point-of-sale because they weigh less than about 4.54 Kg (10 lb). Such goods, referred to herein as "small goods" are generally, individually, small articles such as candy puffs, malt balls, popcorn, artificial Easter eggs, Easter grass, or pulverulent or granular material such as soil in which a flowering or non-flowering plant lives, or the plant may be potted in a conventional flower pot. Such goods which rely on spur-of-the-moment sales to an individual customer are characterized by their reliance upon sensual appeal, whether it is their aroma carried by air flowing over the goods, or their freshness to the touch, or their visual appeal, or each of the foregoing. For example, a decision to buy popcorn, or to buy a growing plant, particularly one in flower, is generally accepted, if not expected, to have been made on the spur-of-the-moment. Even if the decision to buy popcorn or a plant of a specific generic type is not made on the spur of the moment, the choice of a particular bag of popcorn, or of a particular growing plant, is. An appropriately decorative container serves not only to make the sale, but to identify the goods therein, to allow air circulation over the goods, and, if desired, provide information about the volume contained, and/or instructions with respect to how to use the goods, or, how to care for them.

The terms "trapezium", "trapezoid" and"trapezoidal" are used herein as equivalents to denote a quadrilateral having two parallel upper and lower sides, the lower side being shorter than the upper, with the remaining two side sides being equally angulated, but oppositely directed. The closed end of the container is referred to as the "base" despite being nearer the apex of the triangle (which the container would form if the angulated sides were extended to intersect) than the unsealed longer sides which form the open upper end or "mouth" of the container, because, in use, its mouth is uppermost.

Accordingly, this invention more particularly relates to a novel decoratively ornamented non-closable trapezoidal container formed from a web of essentially transparent synthetic resinous film uniquely printed on the container's exterior surface, in the lower portion thereof, with high-gloss inks of contrasting color in only the lower printed portion, preferably containing a varnish, or overlaid with a coat of varnish, the upper portion of the container being essentially transparent and preferably, foraminous; and, to a continuous method of making the container from twin superimposed webs, each printed in substantially the same way, or, from a single web folded along its central longitudinal axis to produce substantially the same result as the twin webs.

By "high-gloss" ink is meant one which when viewed as a printed layer has a gloss index in the range from about 70–98. By "essentially transparent" film is meant "permeable to visible light" such that at least about 90% of the surface area of the upper portion of the container is free from printing which interferes with the transparency of the upper portion. "Upper" portion refers to the transparent portion above a "lateral line" in a region lying in the range from about one-half to about two-thirds vertically above a liquid-impervious planar edge which is the container's bottom. The "lateral line" refers to a line, preferably serrated or crenelated, preferably dram above the vertical half-way distance between the upper and lower edges of the superimposed webs, but below one drawn through a point at a height two-thirds the vertical distance between the upper edge and the bottom, the line being nearer the upper edge than the bottom. The phrase "lower printed portion" refers to the ornamented printed portion in the area below the lateral line.

Flat containers, generally referred to as "plastic bags" are currently made in a variety of shapes and sizes, including trapezoidal bags, by joining together along three sides, along the entire length of each side, upper and lower webs of transparent heat-sealable film printed with the tradename of the seller, the trademark, a pattern of stripes and squares or other geometric design, or a likeness of the contents, for example, a poinsettia plant. To my knowledge, such bags are made from heat-sealable polyolefin film or polyester film, typically thin polyethylene or cast polypropylene film, and printed with inks against the transparent background so that a profusion of printing is scattered in separate regions across the entire container, or, only a minor proportion of the lower portion of the web is printed with a discontinuous layer of printing ink applied in a substantially uniform coating.

In some instances, a web of film made opaque with an ultrathin, non-self-supporting, reflective layer of bright metal, deposited by known techniques and referred to as "metallized film", is overprinted with a single color with substantially transparent ink. Hereafter, for brevity, the ultrathin, non-self-supporting, reflective layer of bright metal is referred to as "the ultrathin layer" to distinguish it from foil which is self-supporting. The thickness of the ultrathin layer, most preferably of aluminum, ranges from about 0.5 micron (0.5μ) to about 4μ, and the coated film has an optical density of $<4$ (less than 4). By "substantially transparent ink" is meant an ink which is permeable to at least 20%, and preferably a major portion, of visible light incident upon it. Trapezoidal bags formed of metallized film have no upper portion which is essentially transparent, nor are they completely covered with printing ink in their lower portion. Minor portions of metal have been removed from within both the lower and upper printed areas in prior art bags, but this amount removed in the upper printed area is typically less than about 20% of the metallized surface, so that the upper area is not essentially transparent.

Such printed metallized flat trapezoidal bags are used to package vegetables and fruits at grocery stores, and in a host of other applications including for advertising at ball games where a bag may be used as a rain hat, by inverting the bag over one's head.

Recognizing the importance of providing a foil wrap which serves as a marketing tool, and of providing a more attractive package for goods, U.S. Pat. No. 4,297,811 to Donald E. Weder (U.S. class 47/subclass 72) provides a decorative wrapping material in the form of a flexible self-supporting aluminum foil panel having a multicolor appearance. One surface of the aluminum foil is covered with relatively thick and relatively thin layers of ink of a single color, spaced apart by uncoated areas of metallic foil, to produce an effect referred to as "racing stripes". The other surface of the aluminum foil is laminated to a thin layer of plastic material. The function of the metallic foil is to emphasize the delineation between the inked areas and to enhance the variation in color intensity between adjacent areas. The overriding function of the '811 wrap is to attract the attention of a customer easily attracted by wrappings, if not goods, that glitter.

However, to attract the attention of a sophisticated prospective purchaser, the container must do better than simply glitter; it must identify the goods, as well as provide an immediate visual indication of the volume of the goods contained. To this end, in this invention, when a container is to be used for popcorn, the exterior surface of its lower portion is imprinted with the likeness of freshly popped corn, in vivid, living, deep golden color against a bright background of light yellow, the remaining upper portion being substantially uncolored and clear, that is, light permeable. A container to jacket a live potted plant is imprinted with leaves, preferably generic to the plant. The light-permeable upper portion of the container allows (a) identification of the plant which must be clearly visible in normal indoor or outdoor lighting, with the naked eye, (b) disseminates the fragrance of the plant, and (c) provides ambient air for transpiration.

A trapezoidal bag, referred to as a Combined Shipping and Packaging Envelope for a Potted Plant, is disclosed in Des. 259,333 to Charbonneau, showing a printed lower portion contrasted with a white upper portion the margins of which contain portions of the same primed color which covers the lower primed portion. These marginal printed portions are referred to as "print overlap" or "overlap". No prior art trapezoidal container has been formed in which printed images cover substantially its entire lower portion of a defined lower portion of the container with a continuous layer of printing ink, the remaining upper portion being free of overlap. By "substantially its entire lower portion" is meant that the lower printed portion is covered with ink over from about 90% to 100% of the area of the lower portion. The lowest portion near the container's bottom edge may be preserved in an unprinted condition to facilitate the bottom being heat-sealed in the unprinted region. Prior art trapezoidal bags have been partially printed in their lower portions with a discontinuous layer of printing ink typically covering less than about 50% of their lower portions, or have deliberately maintained designated unprinted areas in the lower printed portion.

No prior art trapezoidal container has (i) only its entire lower portion covered with the ultrathin layer, sequentially over-printed with contrasting colors of a transparent ink, including a varnish to produce a high-gloss printed surface, and, (ii) its upper portion permeable to visible light. No prior art trapezoidal container has (i) only its entire lower portion sequentially printed with contrasting colors of essentially opaque inks, including a varnish to produce a high-gloss printed surface, and, (ii) its upper portion permeable to visible light. It is conceded that, a printer of polyolefin film, who prints with high-gloss colored transparent inks on metallized film, or high-gloss opaque inks on transparent film, could print substantially the entire lower portion of a web with contrasting colors of high gloss ink, were he instructed to do so, and leave the upper portion unprinted. It is known that transparent ink, printed on the ultrathin layer in a layer from about 1–10$\mu$ thick, allows visible light reflected from the ultrathin layer to pass through the ink, giving the printed image a distinctive bright metallic look.

Similarly, one skilled in the art of designing and constructing containers from synthetic resins would recognize the desirability of maintaining an upper transparent portion for visual inspection of its contents but would have no reason to cover the entire lower portion with a high-gloss ink, brightened by the addition of reflective varnishes which are preferably mutually soluble with the inks. Much less likely would he be likely to consider using a metallized heat-sealable synthetic resinous film, overprinting it to cover the entire lower portion of a trapezoidal flat bag he wished to make, then overlaying the printed portion with varnish. Unexpectedly, the varnish serves two additional functions besides providing high-gloss: it allows etching away only the unwanted portions of the ultrathin layer, and, it provides protection against scuffing of the otherwise unprotected relatively abrasion-prone inks on the exposed exterior printed surface.

There was no recognition in the bag-making art, of the desirability of printing the entire lower portion of a web with high-gloss inks in juxtapositioned regions having different thicknesses, yet to restrict the printing beneath a generally lateral line of longitudinal demarcation between the printed lower portion and the transparent upper portion, for any reason; nor was there any reason in the art to make a multiplicity of trapezoidal bags from a pair of webs, with the restriction that each bag be free of blank or elongated rectangular unprinted portions ("racing stripes") in the lower portion, or, overlap in the upper portion; or, any reason in the art to provide a marker for information directly connected to the use or care of the goods.

Because of the conventional method of making prior art flat trapezoidal bags with essentially no wasted stock, no bag has both, a completely printed lower portion, and, a transparent upper portion. Prior art flat trapezoidal bags have either a racing stripe in the lower portion, or, overlap in the upper transparent portion, as will be explained in greater detail below. In a mass of conventionally printed bags having an upper portion which is transparent, the bags are not identical to one another in that the racing stripes vary in width at the margins of the lower portion of the trapezium; or, in printed bags having their lower portions essentially completely printed, the widths of the overlap vary at the margins in the upper transparent portions. Though only a single bag, conventionally printed in only its lower half, in essentially the entire portion thereof (no racing stripe, no unprinted portions), with the upper portion transparent (no overlap in the margins), could have been individually made from appropriately printed stock, whether a pair of webs, or a single web folded over on itself once, by wasting the remainder of the stock on either side, such a method of making a bag would not be considered for a commercial bag-making machine which must make a multiplicity of bags with a minimum of wasted stock. In bag-making, the stock which is fed essentially continuously to the bag-making machine. The method of this invention permits making a mass of containers, the mass comprising a multiplicity of individual, identically uniquely printed containers, by deliberately wasting stock, more than one-half that used to make the container, but limiting the waste to less stock than is used to make the container.

SUMMARY OF THE INVENTION

It has been discovered that a pair of panels from at least one web of thin, self-supporting synthetic resinous film, decoratively and informationally printed, may be heat-sealed along its oppositely angulated sides, and bottom, to form a flat, uniquely, brightly printed trapezoidal container without a handle, which container provides a single nonsealable cavity. The cavity does not exist when the container is empty because the panels lie congruently one upon the other. The container, which may also be formed from a single web, folded double, serves not only to identify the goods contained and to attract the eye, but to protect the goods prior to their being used at their destination. The container may be used to carry small goods or hold soil in lieu of a pot, with a plant growing in the soil; or, the container may snugly jacket the pot of a live potted plant. The thickness of the empty container is the combined thickness of the pair of panels, each imprinted in a lateral plane to the same extent relative to an axis at right angles to the longitudinal axis, with decorative, preferably goods-identifying images in multiple contrasting colors with high-gloss printing.

It has further been discovered that a web which is printed in at least about one-half a longitudinally divided width thereof with differing thicknesses of high-gloss inks of contrasting colors, may be formed into a uniquely printed trapezoidal container to display a pattern of bright images in only the lower portion thereof without a racing stripe or other unprinted portion, and without an overlap of elongated rectangular print in the margins of the upper portion of the trapezoid.

Trapezoidal panels are formed from either (a) a pair of printed webs by being linearly sealed along each of three sides, or (b) a single web folded double along its central longitudinal axis, and sealed on its two oppositely angulated sides.

It is therefore a first general object of this invention to provide a flat trapezoidal container of transparent film, having particular dimensional characteristics and ornamental printing, to form a single, generally frustoconical cavity with only two panels which, when partially filled with a mass of small goods, remains open at the container's mouth. Because the container is made by a novel method, the container's lower printed portion is free from a "racing stripe" which would break up the continuity of the printed image around the entire circumferential area of the lower portion of the container, and is also free of the "overlap" which in conventional manufacture, indicates a tolerance of poor quality in addition to partially impeding the view of the contents in the upper transparent portion of the container.

The container, in one embodiment, is made from two flat panels of film stock, each panel cut from a continuously printed web and simultaneously sealed to form the trapezium, each panel being of substantially the same shape and area. The lower portion of the container is sequentially imprinted on its exterior surface at multiple printing stations, with opaque bright inks in layers, to provide a pattern of repetitive elements in multiple contrasting colors, each contrasting color consisting of at least one layer of ink. The juxtapositioned colors in different dry thicknesses, in the range from $0.5\mu$–$10\mu$, are preferably overlaid with a layer of varnish having a dry thickness in the range from $112\mu$ $12\mu$ to provide a gloss index in the range from 70–98. Still further, the level to which the printed image rises in the lower portion of the container may serve to quantify the volume of the goods contained, that volume being written on a "marker" printed in a small region of the upper portion. Preferably, the marker provides additional information, such as the weight of the goods, instructions as to the use or care of the goods, or instructions for the use of the container itself.

Linear seals to form the side edges of the container, and at its bottom, are impervious to water. When the cavity is distended by being filled with a predetermined volume of small goods, or by being snugly fitted around a flower pot, the entire outer surface of the container, except for an empty transition zone near its base, presents a smoothly arcuate surface, free of creases or folds, of the frustum of an inverted cone. The art has never suggested providing such a transition zone which is dimensioned so as to be hidden beneath the pot when it rests on its bottom without either destabilizing the assembly of container and sheathed flower pot, or having "ears" protruding from the circumference of the covered bottom of the flower pot.

When the container is used to jacket a conventional, standard flower pot (in shape, the frustum of a cone) it is critical that the container be dimensioned so that the bottom circumferential edge of the flower pot defines the upper line of demarcation between a frustoconical cavity filled with the flower pot and an empty transition zone, and that the transition zone be effectively concealable beneath the bottom of the flower pot when the container is set down on its bottom.

In the preferred embodiment, it is essential that the lower printed portion be free from elongated rectangular unprinted portions, that the upper portion be essentially transparent, and that the finished printing consist of juxtapositioned regions of layers of different thicknesses of high-gloss ink on the exterior surface of the walls of the container, either miscible with, or overlaid with a layer of multifunctional varnish; and, that the printing extend longitudinally from one side of the container to the other without interruption. It is most preferred that the upper transparent portion of the container be perforated to provide air circulation and to emphasize and promote the transparency of the upper portion; and, that it be manually detachable by tearing it off along multiple spaced-apart slitted perforations ("slits") generally laterally disposed, preferably in a series of crenelations generally conforming to the lateral line of demarcation between the lower printed portion, and the upper transparent portion.

Depending upon the method of making the novel container, in a less preferred second embodiment, the container may display at least one but not more than two, transparent racing stripes in its lower printed portion; or, in a less preferred third embodiment, the container may display at least one but not more than two rectangular elongated regions of printed matter in the transparent upper portion, referred to as "overlap" in the art, as illustrated in Des. 259,333. These distinctive configurations, referred to as "the racing-striped print" and "the overlapped print" respectively, result from the first and second methods respectively, of making the container comprising forming a succession of bags from a pair of congruently overlaid printed webs, each printed in diagonally opposed areas, in successive areas of the webs, and sealing and severing the bags without wasting web material between successive webs, as explained below.

It is a specific object of this invention to provide the aforedescribed container for a living plant, in which container the unprinted portion of the upper portion is provided with through-perforations to permit the living plant to breathe; the perforations may be provided by needles which produce microperforations, each having a circumferential ridge and a diameter in the range from about 0.25 mil (6.25$\mu$) to 5 mil (125$\mu$). Alternatively, the perforations may be relatively large holes in the range from about 4 mm to 12 mm in diameter, punched from the film with a punch having a sharp circumferential edge. The ratio of the area depleted by the perforations may range from about 5% to about 25% of the area of the upper portion and is insufficient to weaken the upper portion so greatly that a portion may be ripped off when it is manually gripped to carry the weight of the small goods in the container.

It is another specific object of this invention to provide a container for a living plant, in which container the lower printed portion is provided with a bright pattern, or images of bright leaves or flowers, or both, provided by differing colors of ink, or different thicknesses of the same ink, to give the visual impression that the plant has foliage starting from the ground level, and no unhealthy foliage or flowers; and, the upper transparent portion is perforated.

A conventional first method forms the racing striped container using substantially all the web material of both overlapping webs to successively produce a multiplicity of containers which are packed in a mass of a predetermined number. The method requires using two webs, each of which is printed in its longitudinal direction with successive printed portions, one a mirror image of the other (with the length of the mirror in the longitudinal direction and its surface in the vertical plane), the mirror images being spaced-apart from each other along the longitudinal axis of the web, by more than the width of the area of the essentially clear upper portion. This first method is conventionally used to form a trapezoidal sleeve, typically open at both its ends formed by parallel but oppositely disposed upper and lower ends respectively. Such sleeves are currently produced for protecting plants and fleshly cut flowers, and the sleeves are imprinted with instructions as to how to care for the type of flowers sleeved.

A conventional second method which produces an overlap in the upper portion comprises the same steps as those of the first, except that in each web, the successive mirror images are spaced-apart from each other along the longitudinal axis of the web with a spacing which is less than the width of the area of the lower portion, typically from 1–3 cm, to allow for misalignment of the superposed webs.

A third method, that of this invention, requires using webs in which there is no mirror-image printing, and requires, for each container made, discarding trapezium-shaped portions of material sufficient to form more than half but less than a whole container. As before, each container is made sequentially by thermally sealing the equally, but oppositely angulated side edges of the trapeziums and the shorter of the remaining parallel sides. The unexpected benefit of wasting such a large portion of material is that the container formed is unique in that the printed portion continuously covers the exterior surface of the lower portion, and the upper essentially transparent upper portion is free from any portion of the printed design appearing in the lower portion. The same is true if one used a single web, printed symmetrically about its central longitudinal axis, and folded double before heat-sealing its oppositely angulated sides.

A method for forming a container comprises, feeding first and second webs of substantially similarly imprinted thermally sealable synthetic resinous film from a pair of spaced apart feed rolls in unspaced-apart overlapping relationship over a lateral support surface, each web being in the range from 0.5 rail (12.5$\mu$) to 2 rail (50.8$\mu$) thick and having continuously imprinted, in overlapping lower printed portions thereof, an ornamental decorative design of contrasting bright colors;

maintaining constant tension over the length of each web as the webs travel over the support surface;

continuously advancing the webs longitudinally along the support surface;

interrupting the webs on the support surface to stop them at predetermined intervals without interrupting feeding of the webs from a pair of feed rolls;

heat-sealing the webs together along a longitudinal line to provide a water-impervious bottom planar edge for the container, and, along equally angulated but oppositely directed side edges, to provide the container's exterior lower portion with a printed, smoothly planar surface uninterrupted by an elongated blank rectangle at a side margin in the lower portion, and, an essentially light permeable upper portion free from any portion of printing present in the lower portion;

discarding material intermediate sequentially heat-sealed containers, this material being in an amount more than one-half that required to form the container; and, collecting a mass of individual and separate containers.

In the particular instance where the air circulation is desired over the product, as when a container is used to hold a live plant, the method comprises, in addition, perforating the essentially light-permeable upper portion with sufficient through-perforations to provide circulation of ambient air though the upper portion, and, optionally, a series of lateral, closely spaced perforations, generally coincident with the lateral line, resulting in a weakened tear-off line to facilitate separating the transparent upper portion from the printed lower portion, if so desired, but not weakened sufficiently to tear off under the weight of the container and its contents when grasped by its upper portion.

It is surprising that a trapezoidal container formed with perforations, as described, from thermoplastic heat-sealable film in the range from 0.5 mil to 1.5 mils thick, when perforated with a series of generally lateral, closely spaced slits, withstands the forces generated by manually lifting the container filled with the desired contents, by grasping the container's upper portion, without tearing it, yet permits that upper portion to be torn away when desired.

It is also surprising that a container may be dimensioned to snugly fit over a flower pot and hide the distended transition zone under the pot without upsetting the balance of the pot. The dimensions are selected to provide predetermined ratio of the linear width of the mouth to the length of the bottom.

BRIEF DESCRIPTION OF THE DRAWING

The foregoing and additional objects and advantages of the invention will best be understood by reference to the following detailed description, accompanied with graphical illustrations of the preferred embodiments of the container and the process for making it, in which illustrations.

DETAILED DESCRIPTION OF PREFERRED EMBODIMENTS

Figure 1:
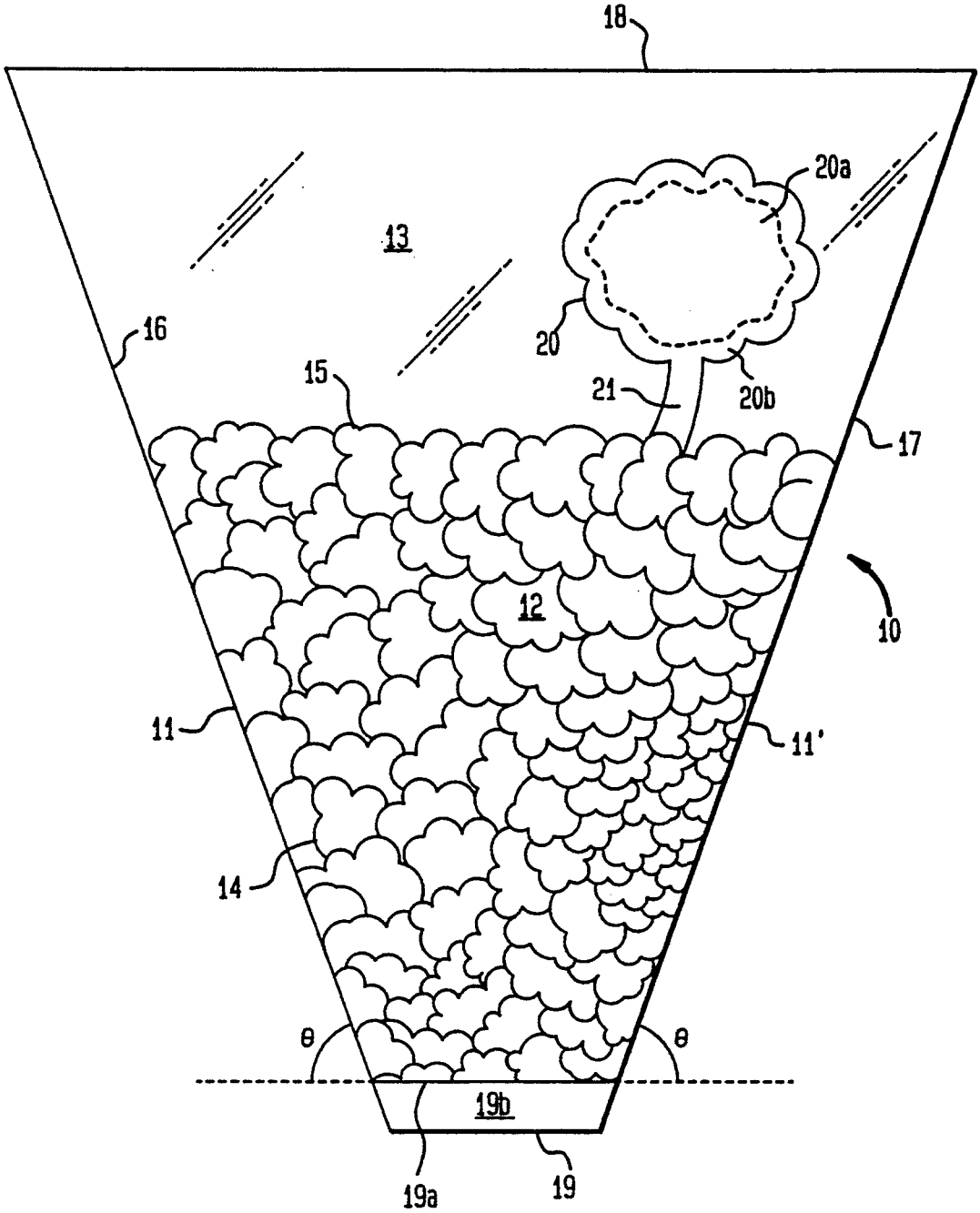
FIG. 1 is a front elevational view illustrating the container of functionally printed film, to hold small goods such as popcorn, identified in the printed image; the lower printed portion comprises different thicknesses and/or intensifies of one or more printing inks, and the lower printed portion is free from a "racing stripe"; the upper portion is substantially clear film, free from "overlap". In side elevation, the container appears as a line because the film is nominally designated as being less than 2 mils thick.

Referring to FIG. 1 there is shown a container indicated generally by reference numeral 10 which in front elevational view, is trapezoidal, comprising, coextensively superimposed upper and lower panels 11 and 11' respectively, of essentially equal area, only the from (or upper) panel 11 being visible in this view. Each panel has a lower printed portion 12 and an upper portion 13 separated by lateral line 15 drawn along the tops of a printed design 14 of small goods. The illustrated design 14 comprises an image of a profusion of popped kernels of corn printed in dark and light golden colors, the central mass of each kernel in a thin layer of cream colored ink indicated by **14*a*, and its boundary region indicated by a thicker layer 14*b* of the same ink. The upper portion 13** is essentially transparent and imperforate to contain inanimate goods.

When distended to form a frustum, the volume of the kernels filling the cavity within the frustum up to the lateral line, is stated on a marker 20 printed in the shape of an outsized popped kernel, printed against the transparent upper portion 13. Like the popped kernels in the lower printed portion, the marker is printed in contiguous contrasting colors, the border **20*b* being of a different color, or thickness relative to the layer 20*a* within the border, the inks being chosen to provide a high-gloss. The marker contains the information that the volume of the frustum up to the lateral line is 1 liter. The marker may contain additional information, as shown, to ensure that the goods contained are identified in the design as being "freshly popped corn". As illustrated, the marker 20 is printed atop a narrow support 21** to provide the visual impression that the label is on a stake planted in the goods contained therein. In addition to, or in lieu of the volume, the marker may bear instructions for preparation of the goods, prior to their consumption, and other information relevant to the sale, use, or prolonged care of the goods. For example, such instructions might include directions for using the popcorn to make a confectionery. No portion of the upper portion is printed with the design covering the lower printed portion, and except for the marker, only the lower printed portion is typically covered with at least two, and up to four layers of printing ink.

Each panel 11 and 11' has a pair of equally angulated but oppositely directed side edges 16 and 17 which are joined in a thermally formed adhesive-free linear seal which is liquid-impervious and impervious to melted butter; and each panel has opposed, parallel, spaced-apart upper and lower sides 18 and 19, only the shorter (lower) sides of which are also thermally heat-sealed without using an adhesive, to provide a planar bottom edge **19*b*. The upper sides provide smoothly laminar edges which form the mouth of the container. Typically and preferably, the bottom edge 19*b*** is formed in an unprinted portion of each web to effect a more reliably impervious seal than if the seal was effected in the printed portion.

Upon distending the mouth of the container 10 and filling it with popcorn, the printed images are continuously displayed around the circumferential exterior surface of the frustum with only opposed angulated lines being visible where the edges of the panels were heat-sealed.

The container is preferably made from film preferably from 0.5 mil to 1 mil thick, provided the film is essentially transparent and can be printed with varying thicknesses of colored inks, and more preferably can have a layer of bright metal about 1$\mu$ thick deposited on the film before it is printed. Most preferred films are polyolefins, particularly polyethylene and polypropylene; polyesters, particularly polyethylene-terephthalate; and, nylons all of which are well known in the an to be amenable to be printed as required above. Most preferred bright metal for deposition is aluminum, though copper, silver and gold may be used. The process for depositing the metal and overprinting with ink is known and practiced according to the teachings of patents assigned to Beckett Industries, Greer International and Solar Press. The process of depositing the metal on the film forms no part of this invention.

As is also well known, small goods are conventionally packaged in containers or bags which are cylindrical when filled, or which are rectangular parallelpipeds, because they provide efficient use of shipping volume. Incidental to presenting the volume of small goods more decoratively but less economically than in a cylindrical or rectangular parallelpiped, it is essential that aesthetic proportions of the container not be vitiated. To provide such aesthetic proportions, the shorter side (the bottom) is at least 5 cm, though it may be as wide as 25 cm; and that the remaining dimensions of the container be chosen from within the ranges, or, ratios in the ranges given below:

the angle $\Theta$ is in the range from 70° to 85° to the horizontal;

the lateral line 15 providing demarcation between the upper and lower portions 13 and 12 respectively provides printing in an area which extends in the range from above 50% to about 65% of the vertical height, that is, the distance between the bottom 19 and the upper side 18 of the trapezium;

the overall height of a trapezium is determined by the ratio of the length of the upper side 18 to lower side 19, and is at least 2:1, generally being in the range from 2:1 to about 5:1.

A characteristic of the container having appropriate dimensions in the foregoing ranges is that if it used to hold pulverulent soil for growing a living plant without a flower pot, the soil-filled container in which the transition zone is also filled, when placed on its bottom on a planar surface, is unstable because it has no structural support.

Figure 1A:
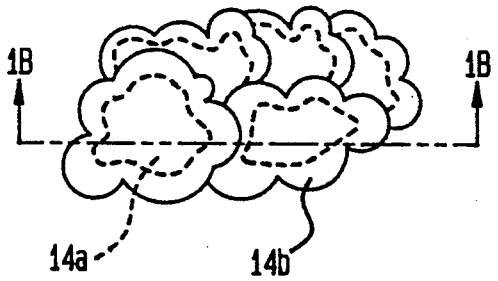
FIG. 1A is a detail, front elevational view, about actual size, of a section of a portion of the film printed on its exterior surface, illustrating the contiguous layers of different colors or thicknesses of high-gloss ink providing relatively dark and light colors to identify the popcorn, which colors are printed in opaque inks to provide a brightly luminescent lower printed portion in which there is no visible unprinted portion.

Referring to FIG. 1A there is shown in detail a printed section of cast polypropylene film 31 of a panel 11, in which annular boundary regions **14*b* in individual kernels of popped corn, lying in the area between the dotted lines within each kernel and its periphery, are printed in a greater thickness of opaque ink than that of the central portion 14*a*** bounded by the dotted line. The mass of ink representing each popped kernel is in different thicknesses of the same or different inks which absorb all wavelengths in the visible range except for those which provide the desired contrasting colors.

Figure 1B:
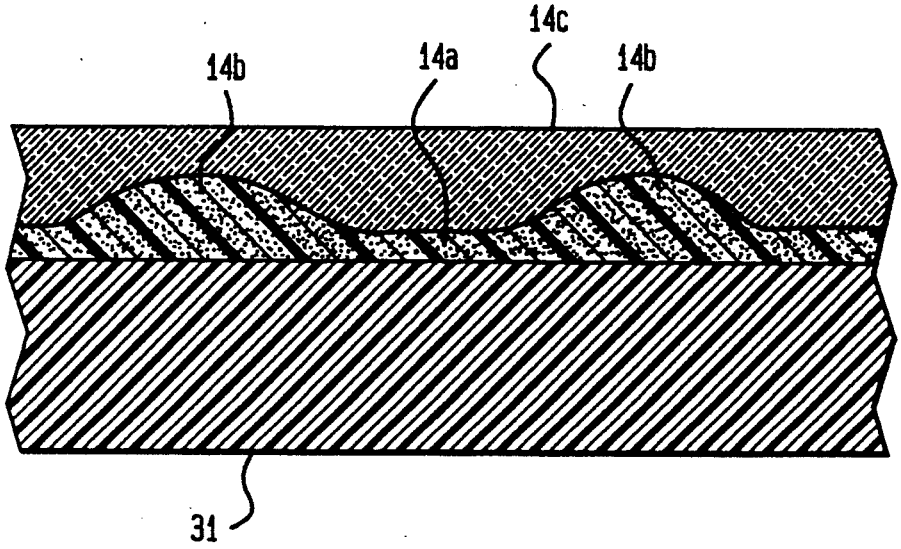
FIG. 1B is a detail of FIG. 1A, greatly enlarged to show details of a single kernel of popcorn as viewed from the bottom along the line 1B—1B, looking in the upward direction indicated, so as to see the edge of the film, and a portion of the printed contiguous dark gold and light cream colors on the exterior surface of the film.

Referring to FIG. 1B there is shown in detail an elevation view of film section 31 with portions broken away, showing its exterior surface coated with an opaque layer of ink **14*a*, coated in a thickness less than that of a second layer of opaque ink 14*b*. If these inks have the appropriate amount of varnish mixed therein, they will meet the required high-gloss of at least 70. If they do not meet the requirement, a layer of varnish 14*c*** is overlaid on the printed image.

Figure 1C:
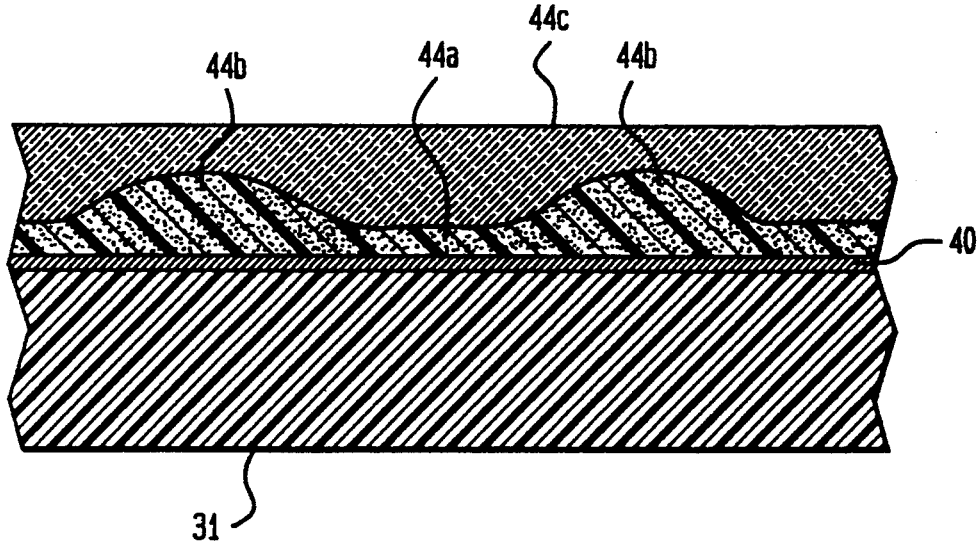
FIG. 1C is a detail again greatly enlarged as in FIG. 1A, illustrating an ultrathin layer of bright metal deposited on the exterior surface, and printed with transparent inks.

Referring to FIG. 1C there is shown a section of another panel 31' with portions broken away, showing its exterior surface coated with an ultrathin bright layer 40 of aluminum metal. Printed on the bright layer is a transparent layer of ink **44*a* in a thickness less than that of a second layer of transparent ink 44*b*. If these inks have the appropriate amount of varnish mixed therein, they will meet the required high-gloss of at least 70. If they do not meet the requirement, a layer of transparent varnish 44*c*** is overlaid on the printed image.

Since the metal-deposition step results in a bright layer of metal over the entire surface of the printed web, the metal must be removed from those areas where the film is to result in the transparent upper portion of the container. To do this, the metal-coated printed web is overprinted with a resin in the form of a varnish which is inert and insoluble, in only those portions where the printing is to survive. The resin-coated web is then immersed in a metal etchant and the metal is etched away leaving the resin-coated printing. If desired, the resin is then removed by dissolving in a suitable solvent which does not dissolve or react with the printing ink. Though the process of removing deposited metal is known, the printed web, printed as stated herein, and overlaid with metal only in the lower printed portion, has never been suggested in the prior art.

Figure 2:
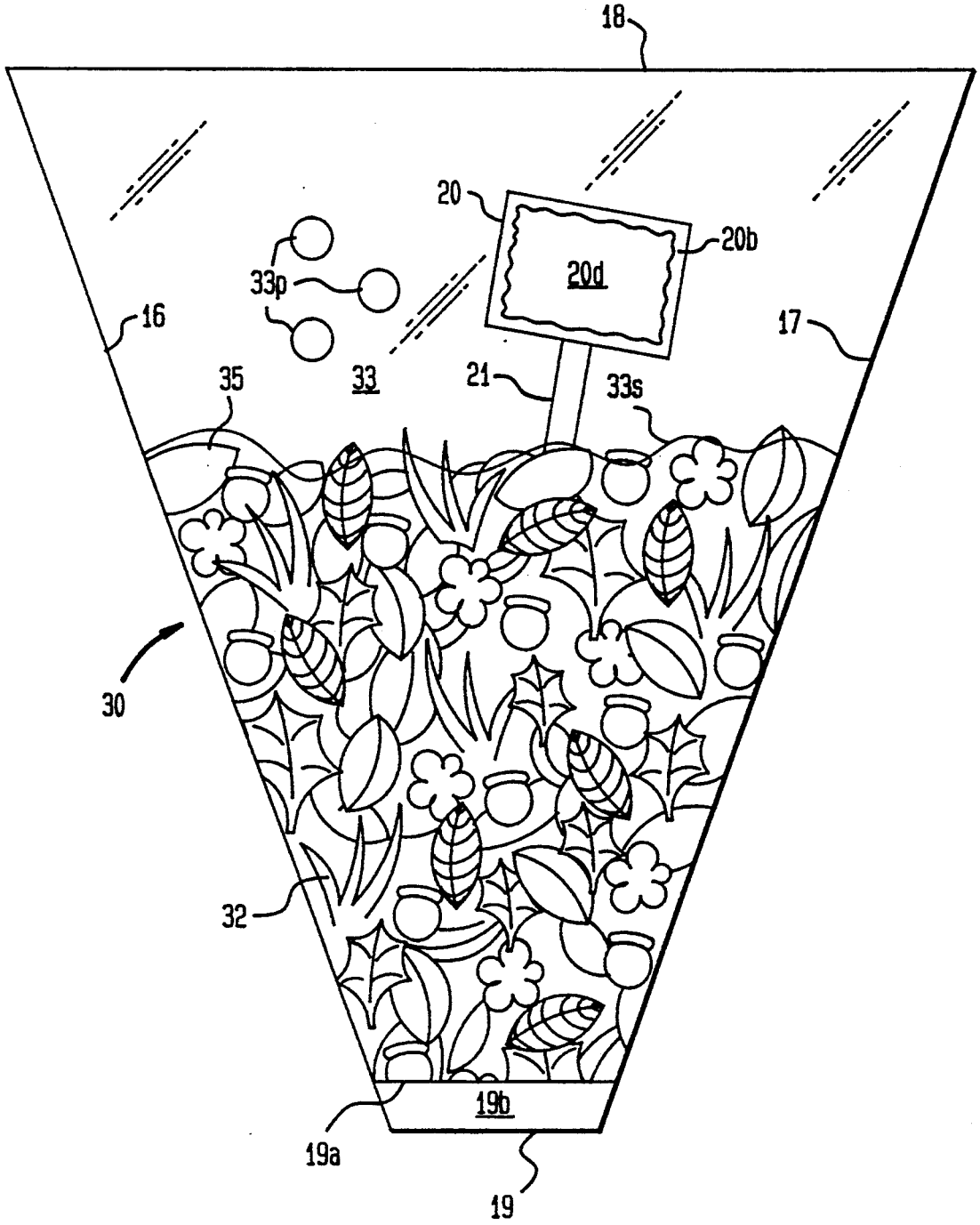
FIG. 2 is a front elevational view showing perforations for air circulation provided in the upper portion; the printing shows leaves of a plant, the container holding soil in which the living plant is to be grown; in addition, slits may be provided along the lateral line, to tear away the upper portion manually, if desired.

Referring to FIG. 2 there is shown a container 30 analogous to that shown in FIG. 1, except that it is printed with brightly colored leaves in the lower printed portion 32. The upper portion 33 is provided with perforations **33*p* to permit live plants to breathe, referred to as "breathing holes". In addition to the breathing holes, the container may be provided with a single set of closely spaced slits 33*s*, in a generally straight line coincident with the lateral line 35, but more preferably in a single jagged line coincident with the boundaries of the leaves. When such slits are provided, it is critical that the spacing of the slits be such that the upper portion 33** will not tear away from the lower portion when the upper portion is grasped to lift the container with its contents. This spacing will vary depending upon the particular choice of contents, but with a typical living plant in a container snugly fitted over a conventional 15.25 cm flower pot having a bottom diameter of 11 cm, the slits have essentially no width, but are in the range from 5 mm to 20 mm long, preferably from 12–16 mm long, and are spaced apart in the range from about 3 mm to 5 mm apart.

Figure 3:
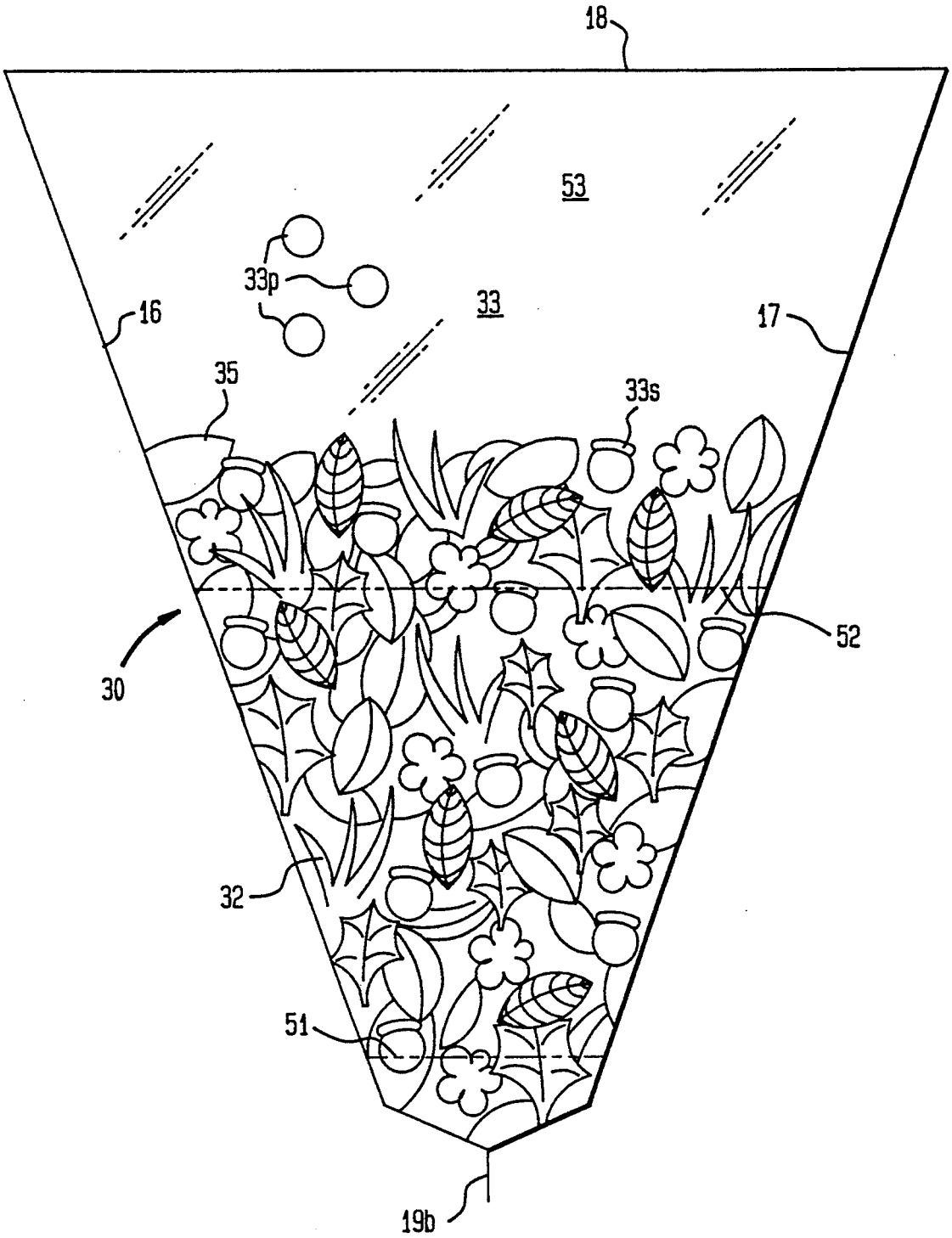
FIG. 3 is a side elevational view of the container shown in FIG. 2, in which a flower pot holding friable soil with live flowers growing in it, is snugly sheathed so as to form the frustum of a cone with an empty transition zone under the pot.

Referring to FIG. 3 there is shown a side elevational view of the frustum formed by sheathing a flower pot, the bottom 51 and top 52 of which are shown in phantom outline). The transition zone includes that portion of the lower printed portion still maintaining a continuing conical form but progressing downward into the form of a V-shaped trough which terminates at its apex at the bottom planar edge 19*b*. The vertical height of the transition zone from its apex to the bottom 51 of the pot is necessarily less than 50% of the diameter of the bottom 51, preferably in the range from 20 to 40%, or the transition zone is ineffectively concealed. Thus it will now be evident that the dimensions of the transition zone is critically related to the size of the flower pot snugly sheathed within it. This formation of a concealable transition zone is best provided by a flower pot having a bottom which is about one-half the area of its open top.

Figure 4:
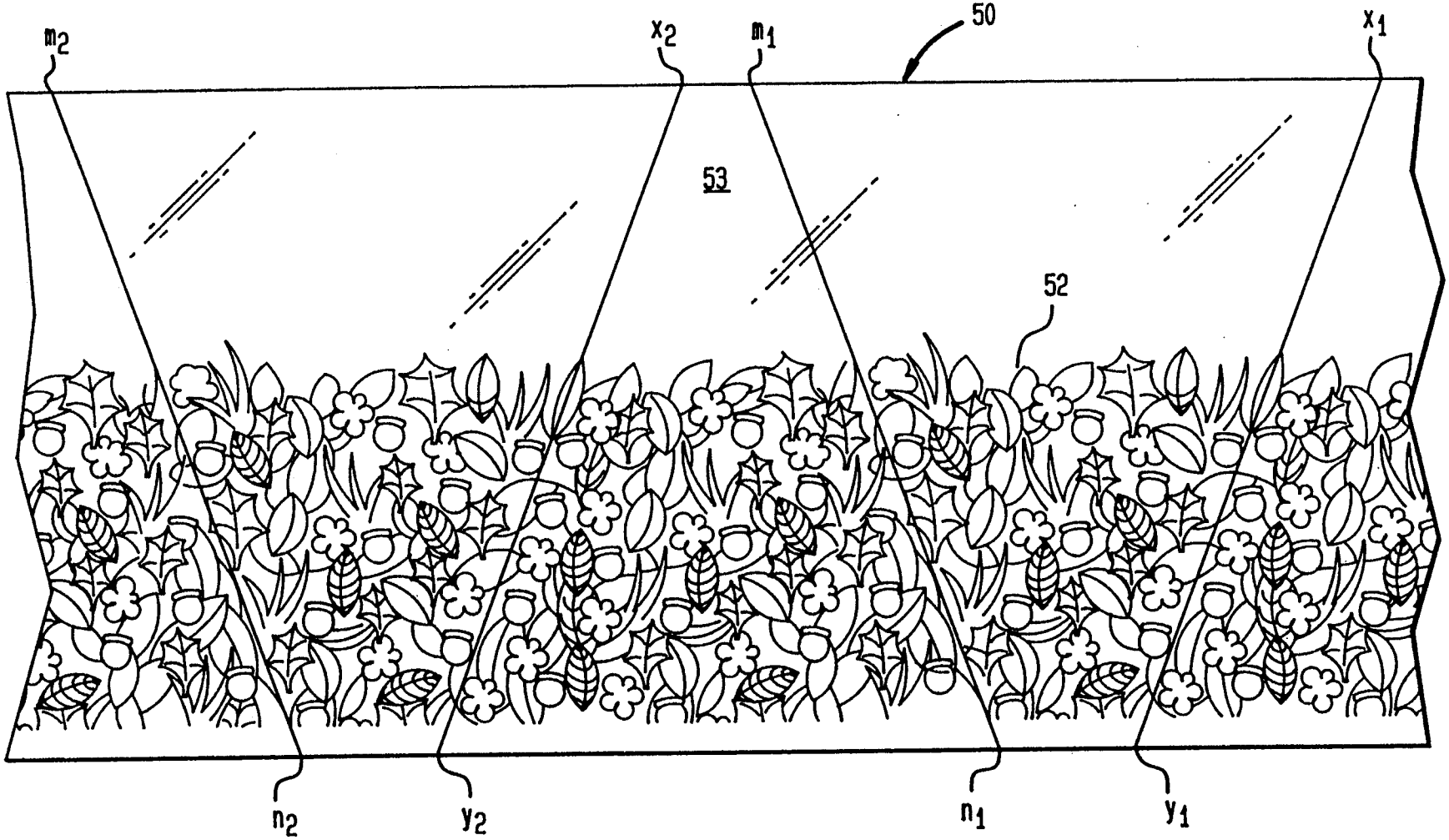
FIG. 4 is a plan view, with ends broken away, of one of two webs of film, each of which is continuously printed longitudinally in only one longitudinal portion, so as to superimpose one primed portion upon the other, illustrating how the webs are cut and sealed as congruent trapezoidal panels to form the container, and wasting the portion of each web between successive containers formed.

Referring to FIG. 4 there is shown a portion of a web of printed film 50 having a clear upper portion 53 and a printed lower portion 52, again showing brightly colored leaves. If desired, the clear portion 53 may be printed with glyphs, logos and the like, typically in an ink of color different from that used in the lower portion 52. The web is used to make a first container 30 by hot-wire sealing and cutting along the side edges $x_1y_1$ and $m_1n_1$, and along the bottom boundary of the printed portion between $n_1$ and $y_1$; and, by indexing the webs in the longitudinal direction, to make a second container 30 by hot-wire sealing and cutting along the side edges $x_2y_2$ and $m_2n_2$, and along the bottom boundary of the printed portion between $n_2$ and $y_2$. As a result, the webs defined by $m_1n_1y_2x_2$ are wasted, the amount of waste being minimized by having $x_2$ as close to $m_1$ as is practical; but the containers formed are free from racing stripes and overlap.

An example of the amount of waste in the production of each container for a typical 15.25 cm flower pot, is approximately as follows: the bottom sealed edge is 11.5 cm, the open top is 48.25 cm and the open tops are sealed 2.5 cm apart, so that two panels of web, each 2.5 cm×40 cm is wasted. The largest container may be made with a web about 48" wide (1.22 meters) to have a base in the range from about 15 cm to 30 cm in length for large plants such as calla lillies or a kangaroo paw plant; the smallest containers may be about 10 cm high and may have a base in the range as small as from about 2 cm to 5 cm.

To avoid such waste, the first and second conventional methods, referred to above, are used. However, the impracticality of indexing the upper and lower webs precisely, due to a host of considerations including expansion and contraction of the webs with temperature, slight changes in tension on the webs, and the like, dictates the steps of the conventional methods.

Figure 5:
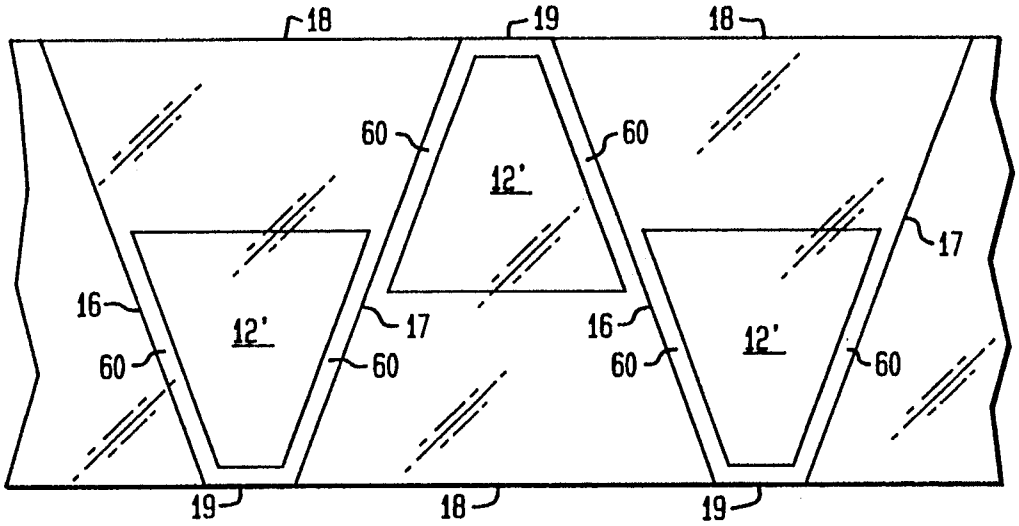
FIG. 5 is a plan view, with ends broken away, of one of two webs of film, each printed along its length, with mirror image portions of what is to become the lower printed portion when the first conventional method is used. The printed portions are disposed diagonally from one another, the lower printed portion being slightly less in area than necessary to ensure that the upper portions do not have "overlap", but resulting in a "racing stripe".

Referring to FIG. 5, there is shown a portion of a web used in the conventional first method of making a trapezoidal flat container, to ensure no overlap because overlap is particularly noted in the art as indicative of a container lacking quality. The diagonally oppositely printed portions 12' of each web are shown in shading. Both webs travel together and stop together, aided with photoelectric eyes (not shown) so that linear heat-sealing and cut-off means can seal and sever individual containers along side edges 16 and 17 so that edges are shared by successive containers. Since panels are hot-wired and cut in an unprinted portion there is left a racing stripe 60 adjacent each side edge. But no portion of the web between successive panels is wasted.

Figure 6:
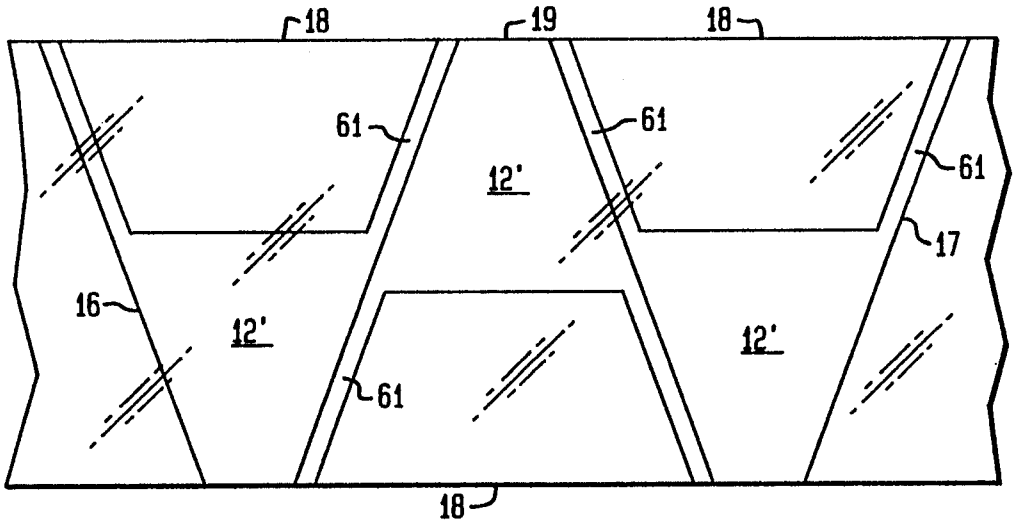
FIG. 6 is a plan view, with ends broken away, of one of two webs of film, each printed along its length, with mirror image portions of what is to become the lower printed portion when the second conventional method is used, and as in FIG. 5, the printed portions are disposed diagonally from one another, the lower printed portion being slightly greater in area than necessary to ensure that the lower portions are not printed with a racing stripe in the lower portion, but resulting in "overlap".
Figure 5A:
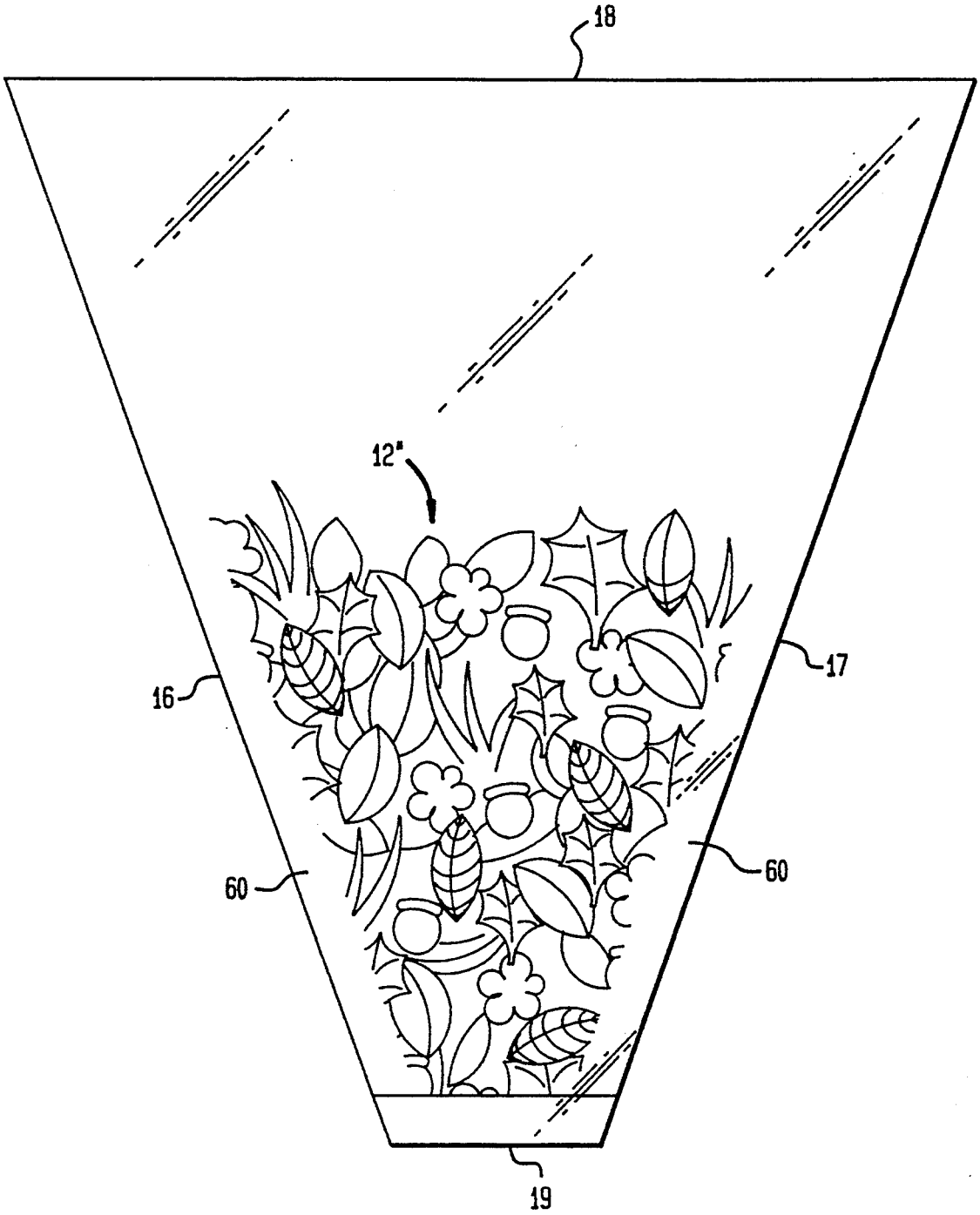
FIG. 5A is an elevational view of a single container formed with the webs illustrated in FIG. 5.
Figure 6A:
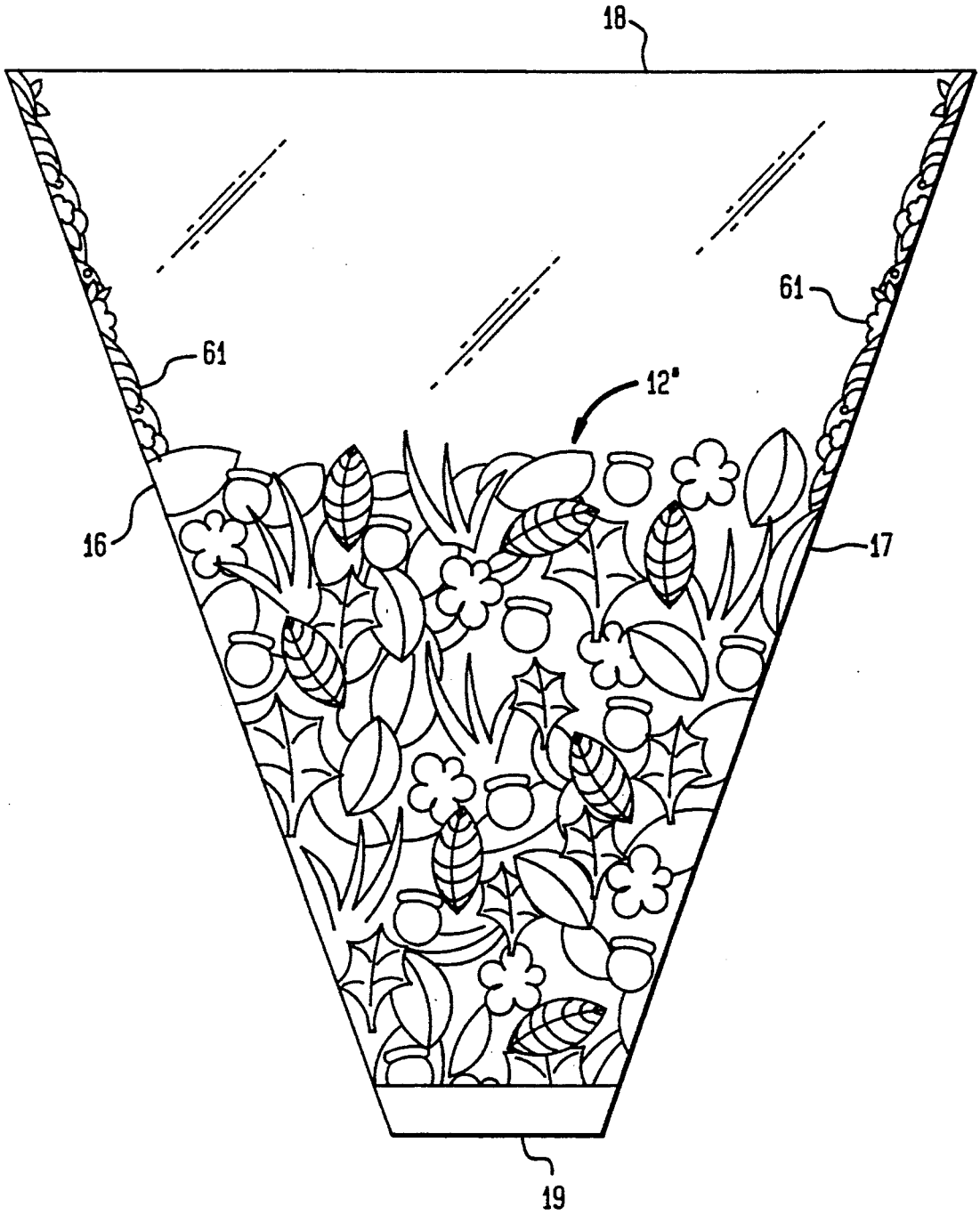
FIG. 6A is an elevational view of a single container formed with the webs illustrated in FIG. 5.

In those instances where "overlap" is tolerated, the second conventional method illustrated in FIG. 6 is used. As in FIG. 5, the primed portions 12" are diagonally opposed in mirror images, except that each printed portion extends longitudinally past the line along which an edge is to be formed. When heat-sealed along shared edges 16 and 17 each container has overlap 61 in the upper portion.

The containers are formed by intermittently advancing, in timed sequence, two webs, congruently, or a single web folded double, to form individual containers in a single heat-sealing station, or multiple stations where a hot wire is applied to the sides and bottom. Though the descriptions hereinabove are specifically directed to a pair of webs, it will be evident to one skilled in the art, that a single web folded double will be equally amenable to production. Machines such as the Guard 200HS and the Lemo 850K or 850KS for producing the containers are available from Guard & Associates, Denver, Colo., Lemo H. Lehmacher & Son GmbH, Niederkassel-Mondorf, Germany, respectively, and other manufacturers of bag-making machines, and form no part of this invention.

It is claimed:

1. A fastener-free, non-closable container for small goods comprising, a pair of decorative flexible self-supporting laminar panels having substantially the same size and shape, one congruently disposed relative to the other and joined linearly at their sides and bottom with water-impervious joints, said sides being equally angulated but oppositely directed so as to form a trapezium;

each said panel being a portion of a web of thermally sealable synthetic resinous film divided by a generally lateral line defining therebeneath, a lower printed portion having a brightly colored appearance, and thereabove, an essentially transparent upper portion, said lateral line being located in a region in the range from about one-half to about two-thirds vertically above said bottom;

said container having a single cavity and an exterior surface only the lower portion of which is essentially completely covered with multiple contrasting colors of printing ink;

said lower portion having an exterior surface upon which essentially no unprinted portion remains, said lower printed portion comprising regions of contrasting colors, each region having a thickness different from another contiguous region, each region comprising from one to three layers of printing ink superimposed one upon the other, each when dry, having a thickness in the range from 1$\mu$ to 10$\mu$, and including sufficient varnish to provide multiple colors of varying intensity providing a gloss index in the range from about 70 to about 98.

2. The container of claim 1 wherein said angulated sides are angulated at an angle in the range from 70° to 85° to the horizontal.

3. The container of claim 2 wherein said lateral line is drawn in a region lying in the range from above one-half but below two-thirds the distance vertically above a liquid-impervious planar edge in said container's bottom.

4. The container of claim 2 wherein said film is in the range from 12.5μ (0.5 mil) to about 50.8μ (2 mils) thick.

5. The container of claim 4 wherein said varnish is present as an outermost layer of varnish having a dried thickness in the range from 1μ to 10μ thick.

6. The container of claim 5 wherein said transparent upper portion is foraminous, having spaced-apart perforations chosen from microperforations in the range from 0.25 mil (6.25μ) to 5 mils (125μ) and breathing holes in the range from 4 mm to 12 mm in diameter in said upper portion, said perforations cumulatively representing an area in the range from about 5% to about 25% of the surface area of said upper portion.

7. The container of claim 6 wherein said upper portion includes a printed marker having at least two regions of different thicknesses of printing inks, one region contiguously disposed relative to another, said marker providing printed indicia therewithin.

8. The container of claim 4 wherein said lateral line has a single set of essentially linear slits coincident with said lateral line to enable said upper portion to be torn off leaving only the printed portion.

9. The container of claim 4 including a non-self-supporting layer of bright metal uniformly and evenly deposited in a thickness in the range from about 0.5μ to intermediate said film's exterior surface and said ink is essentially opaque to visible light.

10. The container of claim 4 including a non-self-supporting layer of bright metal uniformly and evenly deposited in a thickness in the range from about 0.5μ to intermediate said film's exterior surface and said ink is transparent to visible light.

11. The container of claim 5 wherein said varnish is present as an outermost layer of varnish having a dried thickness in the range from 1μ to 10μ thick.

12. The container of claim 6 wherein said perforations cumulatively representing an area in the range from about 5% to about 25% of the surface area of said upper portion.

13. The container of claim 10 wherein said upper portion includes a printed marker having at least two regions of different thicknesses of printing inks, one region contiguously disposed relative to another, said marker providing printed indicia therewithin.

14. A fastener-free, non-closable container for small goods comprising, a single flexible self-supporting laminar web of thermally sealable synthetic resinous film folded upon itself with a single fold-line so as to provide a pair of trapezium-shaped panels symmetrically disposed about said fold-line, said panels having substantially the same size and shape, one congruently disposed relative to the other and joined linearly at their sides with water-impervious joints, said sides being equally angulated but oppositely directed;

said container having a single cavity and an exterior surface only the lower portion of which is essentially completely covered with multiple contrasting colors of printing ink;

said container being divided by a generally lateral line defining therebeneath, a lower printed portion having a brightly colored appearance, and thereabove, an essentially transparent upper portion, said lateral line being located in a region in the range from about one-half to about two-thirds vertically above said bottom;

said lower portion having an exterior surface upon which essentially no unprinted portion remains, said lower printed portion comprising contiguous regions of contrasting colors, each region having a thickness different from another contiguous region, each region comprising from one to three layers of said ink superimposed one upon the other, each when dry, having a thickness in the range from 1μ to 10μ, and including sufficient varnish to provide multiple colors of varying intensity providing a gloss index in the range from about 70 to about 98.

15. The container of claim 14 wherein said lateral line is crenelated.

16. The container of claim 15 wherein said ink is substantially opaque to visible light.

17. The container of claim 15 wherein said ink is substantially transparent to visible light.

18. The container of claim 14 including a non-self-supporting layer of bright metal uniformly and evenly deposited in a thickness in the range from about 0.5μ to intermediate said film's exterior surface and said ink transparent to visible light.

19. In combination, a frustoconical flower pot and a fastener-free, non-closable container therefor, comprising, a frustoconical sheath having a smoothly arcuate exterior surface, an open mouth and a closed bottom terminating in a planar edge and having a transition zone beneath said pot sheathed in said container, said container comprising a pair of flexible self-supporting laminar panels having substantially the same size and shape, one congruently disposed relative to the other and joined linearly at their sides and bottom with water-impervious joints, said sides being equally angulated but oppositely directed so as to form a trapezium;

each said panel being a portion of a web of thermally sealable synthetic resinous film divided by a generally lateral line defining therebeneath, a lower printed portion having a brightly colored appearance, and thereabove, an essentially transparent upper portion, said lateral line being located in a region in the range from about one-half to about two-thirds vertically above said bottom;

said container having a single cavity and an exterior surface, only the lower portion of which is essentially completely covered with a non-self-supporting layer of bright metal uniformly and evenly overlaid in a thickness in the range from about 0.5μ to 5μ on said lower portion;

said lower portion having an exterior surface upon which essentially no unprinted portion remains, said lower printed portion comprising regions of substantially transparent printing ink in contrasting colors, each region having a thickness different from another juxtapositioned region, each region comprising said layer upon which from one to three layers of said ink are superimposed, one upon the other, each when dry, having a thickness in the range from 182 to 10μ, and including sufficient varnish to provide multiple colors of varying intensity providing a gloss index in the range from about 70 to about 98.

* * * * *